United States Patent [19]

Meyer

[11] 4,099,171

[45] Jul. 4, 1978

[54] BRIGHTNESS CONTROL IN AN LED DISPLAY DEVICE

[75] Inventor: John Evert Meyer, Saratoga, Calif.

[73] Assignee: National Semiconductor Corporation, Santa Clara, Calif.

[21] Appl. No.: 763,298

[22] Filed: Jan. 28, 1977

[51] Int. Cl.[2] ..... G09F 9/32

[52] U.S. Cl. ..... 340/335; 315/297; 340/336

[58] Field of Search ..... 340/336, 335; 315/163, 315/294, 297, 299, 301

[56] References Cited

U.S. PATENT DOCUMENTS

| | | | |
|---|---|---|---|
| 3,412,315 | 11/1968 | Hehenkamp | 315/297 X |
| 3,925,690 | 12/1975 | Spence | 340/336 X |
| 3,986,186 | 10/1976 | Cochran | 340/336 X |
| 4,029,991 | 6/1977 | Schultz | 315/297 X |

OTHER PUBLICATIONS

R. T. Gill, "Multiplexing and Individual Addressing the Man I Seven-Segment Display," Electronic Special Products, Nov. 1969.

Howard Borden and Richard Kniss, "Strobing Makes Longer LED Alphanumeric Displays Practical," Electronics, Mar. 2, 1970, pp. 126–130.

R. T. Gill, "Segmented Array Simplifies External Address Circuitry Required for Numeric Display, Strobing Permits Time-Sharing of Logic and Drive," Electronics, Mar. 2, 1970, pp. 132–135.

Hewlett Packard, "Monolithic Solid State Seven Segment Displays," Application Note 933, Nov. 1970.

"Solid State Module Makes for Light Reading," By members of the Technical Staff, Solid State Laboratory, Electronics, Sept. 2, 1968, pp. 74–81.

*Primary Examiner*—David L. Trafton

*Attorney, Agent, or Firm*—Brown & Martin

[57] ABSTRACT

The brightness of given LED segments of each digit section of an LED display device for providing illuminated displays of selected alphanumeric characters is controlled by controlling the amount of energy provided to each given digit section for illumination of the given LED segments in accordance with the selection of the character to be displayed by the given digit section. For example, when a character having only three illuminated segments, such as a "7" is displayed, less current is provided to the digit section than when a character having six illuminated segments, such as a "0" is displayed, thereby providing an apparent uniform brightness as to both characters.

28 Claims, 5 Drawing Figures

BRIGHTNESS CONTROL IN AN LED DISPLAY DEVICE

BACKGROUND OF THE INVENTION

The present invention generally pertains to electroluminescent display devices and is particularly directed to improving the drive circuit of an LED display device so as to provide an apparent uniform brightness as to characters that are displayed in different digit sections of the display device.

A typical LED display device includes a plurality of digit sections. Each of the digit sections includes a plurality of LED segments in an array for providing illuminated displays of selected alphanumeric characters. Referring to FIG. 1, each digit section typically includes at least seven segments "*a*" through "*g*" for displaying numerals "0" through "9".

FIG. 2 shows a portion of a typical drive circuit 10 for one digit section. Each of the LED segments "*a*" through "*g*" is connected in series with a P-type MOSFET semiconductor switch 11 through 17. When the switch 11 is gated closed, the anode of the LED segment "*a*" is coupled to a source of voltage potential $V_{DD}$. The anodes of the other LED segments "*b*" through "*g*" are coupled to the source of voltage potential $V_{DD}$ by the switches 12 through 17 in a like manner.

The cathodes of all of the LED segments "*a*" through "*g*" are connected in common and are coupled to a source of voltage potential $V_{SS}$ by an N-type MOSFET semiconductor switch 19.

A digit section is enabled for display when the switch 19 is gated closed in response to a predetermined first input signal. Typically the first input signals are multiplexed signals for sequentially enabling the different digit sections.

Given LED segments in a given digit secton are enabled for displaying a selected character when their respective series connected semiconductor switches 11 through 17 are gated closed in response to a predetermined combination of second input signals. Typically the second input signals are provided by a character generating circuit.

Accordingly, given LED segments in a given digit section are enabled to display a selected character in response to predetermined combinations of first and second input signals.

With such a typical drive circuit there is an apparent difference in the brightness of the different characters being displayed in the different digit section of the LED display when one character is made up of considerably more illuminated segments than another. To understand this apparent difference in brightness, reference is made to FIG. 3, which is an equivalent circuit or a portion of a drive circuit for one digit section. Each MOSFET semiconductor switch is a poor current source and is considered as equivalent to a perfect switch in series with a series resistance. $R_{P11}$ through $R_{P17}$ represent the internal resistances of the P-type MOSFET's 11 – 17. $R_N$ represents the internal resistance of the N-type MOSFET 19. The potential difference between $V_{DD}$ and $V_{SS}$ typically is provided by a battery, and is represented in the equivalent circuit by a DC voltage source V in series with a resistance $R_B$. $R_B$ represents the internal resistance of the battery, and $V_B$ represents the battery voltage.

When a greater number of LED segments in a digit section is enabled for displaying a selected character, the current through the resistances $R_N$ and $R_B$ is increased. This results in a greater voltage drop across the series combination of $R_N$ and $R_B$. Therefore, there is a smaller voltage drop across the resistances $R_p$ of whichever ones of the switches 11 through 17 that have been gated closed, and less current flow through whichever LED segments that are illuminated. Since the brightness of an LED segment is greater with greater current flow through the LED segment, the result is that digit sections having a significantly larger number of LED segments enabled for display appear dimmer than do digit sections having only a few segments enabled.

Another factor which affects the level of current flow through the LED segments is the internal resistance $R_B$ of the battery. When the number of illuminated LED segments is greater, the increased current flow through the battery internal resistance $R_B$ causes the voltage drop across the battery internal resistance $R_B$ to increase. This in turn decreases the applied potential difference $V_{DD}$ - $V_{SS}$, and thereby provides a lower voltage for driving the MOSFET semiconductor switches 11–17 and 19. The effect of a lower voltage for driving the MOSFET's is that the equivalent resistances of the MOSFET's increase; and as a result the greater the number of segments that are illuminated, the greater is the resistance to current flow that is provided by the N-type MOSFET switch 19 and by those P-type MOSFET switches that are in series with an illuminated LED. Thus the effect of the battery internal resistance is to further increase the resistance to current flow in the illuminated LED segments as the number of illuminated LED segments is increased.

SUMMARY OF THE INVENTION

The present invention is an improvement to an LED display device of the type having a plurality of digit sections, each of which includes a plurality of LED segments in an array for providing illuminated displays of selected alphanumeric characters; a first circuit for separately enabling given LED segments in a given digit section simultaneously for displaying a selected character in response to a predetermined combination of second input signals; whereby the given LED segments in the given digit section are enabled to display the selected character in response to predetermined combinations of first and second input signals to compensate for apparent dimness in digit sections having more segments illuminated than others.

The drive circuit for the LED display device is characterized by a control circuit for controlling the amount of energy provided to each given digit section for illumination of the given LED segments in accordance with the selection of the character to be displayed by the given digit section as indicated by the second input signals.

In one preferred embodiment of the LED display device, the first circuit includes a separate first MOSFET switch for each digit section, such as is in the prior art devices. Each such first MOSFET switch is gated closed in response to a different predetermined first input signal for coupling common electrodes of all of the LED segments in that digit section to a source of a voltage potential. Each such first MOSFET switch has an internal resistance which limits the amount of current flow through the LED segments that are enabled.

The control circuit for this preferred embodiment is characterized by additional MOSFET switches connected in parallel with the first MOSFET switches for decreasing the resistance to current flow when the additional semiconductor switches are gated closed; and a logic circuit responsive to different combinations of second input signals to provide control signals for selectively enabling the closing of certain ones of the additional MOSFET switches in accordance with the particular combinations of LED segments that are enabled for illumination by the second input signals.

In another preferred embodiment of the LED display device, the second circuit includes a separate first MOSFET switch for each common LED segment position in the plurality of digit sections, such as in the prior art devices. Each such first MOSFET switch is gated closed in response to a different predetermined second input signal for coupling the electrodes of the commonly positioned LED segments in the plurality of digit sections to a source of voltage potential. Each such first MOSFET switch has an internal resistance which limits the amount of current flow through the LED segments that are enabled, although the internal resistance is not necessarily the same for all of the first MOSFET switches. The control circuit for this preferred embodiment is characterized by additional MOSFET switches connected in parallel with at least some of the first MOSFET switches for decreasing the resistance to current flow when the additional MOSFET switches are gated closed, and a logic circuit responsive to different combinations of second input signals for selectively enabling the closing of certain ones of the additional MOSFET switches in accordance with the particular combinations of LED segments that are enabled for illumination by the second input signals.

The present invention is also applicable to equivalent devices wherein the other types of semiconductor swtiches are substituted for the MOSFET switches and/or wherein other electroluminescent elements are substituted for LED's.

Other features of the present invention are discussed below with reference to the Description of the Preferred Embodiment.

DESCRIPTION OF THE PREFERRED EMBODIMENT

Figure 1:
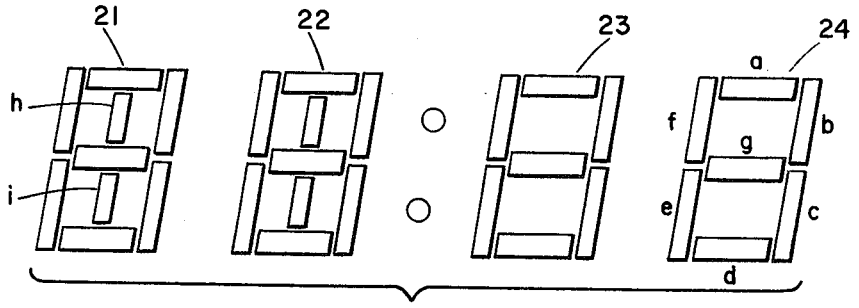
Fig. 1 PRIOR ART
FIG. 1 illustrates a plurality of digit sections, each having a plurality of LED segments in an array for providing illuminated displays of selected alphanumeric characters.
Figure 2:
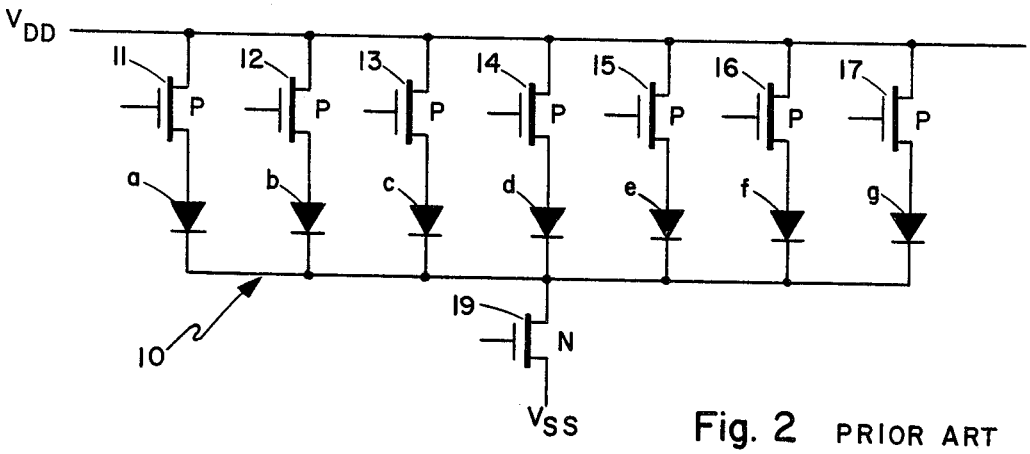
Fig. 2 PRIOR ART
FIG. 2 is a schematic circuit diagram of a portion of a prior art drive circuit for a digit section, including a plurality of LED segments.
Figure 4:
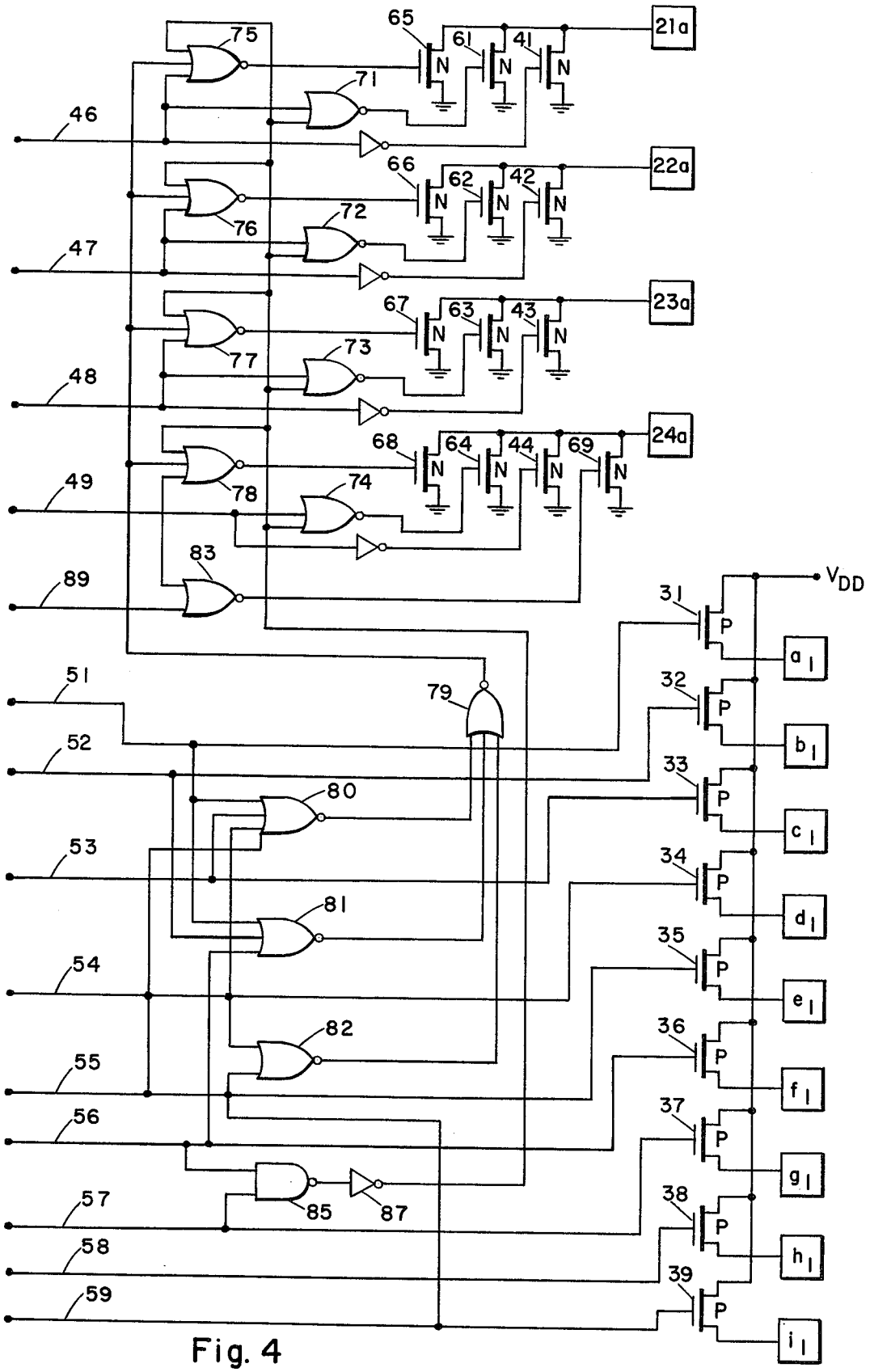
FIG. 4 is a schematic circuit diagram of one preferred embodiment of an LED display device drive circuit according to the present invention.

The preferred embodiment shown in FIG. 4 is designed for driving an LED display such as that shown in FIG. 1.

All four digit sections 21, 22, 23, and 24 include seven LED segments "*a*" through "*g*" in an array for providing illuminated displays of the ten numerals "0" through "9". In addition, digit sections 21 and 22 also include two additional LED segments "*h*" and "*i*", each so that certain alphabetic characters also can be displayed. These characters include "A", "E", "F", "H", "M", "R", "T", "U", and "W".

The connections shown in FIG. 4 to the anodes of LED segments $a_1$ through $g_1$ are made in parallel to the anodes of all commonly positioned segments "*a*" through "*g*" in the four digit sections 21, 22, 23, and 24. The connections shown to the anodes $h_1$ and $i_1$ of the LED segments "*h*" and "*i*" are made in parallel to the anodes of the commonly positioned segments "*h*" and "*i*" in the two digit sections 21 and 22.

Connections also are shown in FIG. 4 to the commonly connected cathodes 21*a*, 22*a*, 23*a*, and 24*a* of the LED segments in digit sections 21, 22, 23, and 24 respectively.

A separate P-type MOSFET switch 31 through 39 is provided for connecting each of the commonly connected anodes $a_1$ through $i_1$ respectively, to a source of voltage potential $V_{DD}$. When the respective switch 31 through 39 is gated closed, the particular commonly positioned LED segments to which the switch is connected in the digit sections 21, 22, 23, and 24 are coupled to the source of voltage potential $V_{DD}$.

A separate N-type MOSFET switch 41 through 44 is provided for connecting each of the commonly connected cathodes 21*a* through 24*a* in each of the digit sections 21 through 24 respectively to a source of voltage potential $V_{SS}$ (shown as circuit ground in FIG. 4).

A particular LED segment is illuminated for display only when it is enabled by both its anode and cathode being coupled to their respective sources of voltage potential $V_{DD}$ and $V_{SS}$.

The cathodes 21*a* through 24*a* are coupled to their source of voltage potential $V_{SS}$ (shown as circuit ground), when their respective switches 41 through 44 are gated closed in response to first input signals received on lines 46, 47, 48, and 49. Accordingly, the LED segments of a given digit section 21 through 24 are enabled only when a binary zero first input signal is received on the input line 46 through 49 to close its respective switch 41 through 44. The first input signals on the lines 46 through 49 are multiplexed so that a binary zero first input appears on only one input line 46 through 49 at any one time thereby enabling the LED segments of only one digit section at any one time.

The anodes $a_1$ through $i_1$ are coupled to their source of voltage potential $V_{DD}$ when their respective switches 31 through 39 are gated closed in response to second input signals received on lines 51 through 59 from a character generator (not shown). A given LED segment "*a*" through "*i*" in any given digit section 21 through 24 is enabled only when a binary zero second input signal is received on the input line 51 through 59 to close its respective switch 31 through 39. Binary zero second input signals necessary for enabling the illumination of all of the segments making up a selected character appear on the second input lines 51 through 59 simultaneously during the interval that the segments of the digit section in which the character is to be displayed is also enabled by a binary zero first input signal on its respective first input line.

So much of this preferred embodiment as has been described to this point is in common with the prior art.

The present invention is characterized by a control circuit for controlling the amount of energy provided to a given digit section 21 through 24 for illumination of the given LED segments "*a*" through "*i*" in accordance with the selection of the character to be displayed by the given digit section as indicated by the second input signals on lines 51 through 59.

The control circuit includes additional N-type MOSFET switches 61 through 69 and a logit circuit that includes NOR gates 71 through 83, a NAND gate 85 and an inverter 87.

The additional N-type MOSFET switches 61 through 69 are connected in parallel with the first mentioned N-type MOSFET switches 41 through 44 as shown in FIG. 4.

The first N-type MOSFET switches 41 through 44 each have an internal resistance which limits the amount of current flow through the LED segments "*a*" through "*i*" that are enabled by a combination of first and second input signals. The additional N-type MOSFET switches 61 through 69 each have an internal resistance such that when an additional N-type MOSFET switch 61 through 69 is gated closed to conduct in parallel with a closed first N-type MOSFET switch 41 through 44, the resistance to current flow through the enabled LED segments is decreased, thereby allowing more current to flow through such segments, which in turn provides more energy for brighter illumination than if only the first N-type MOSFET switch 41 through 44 was gated closed.

Figure 3:
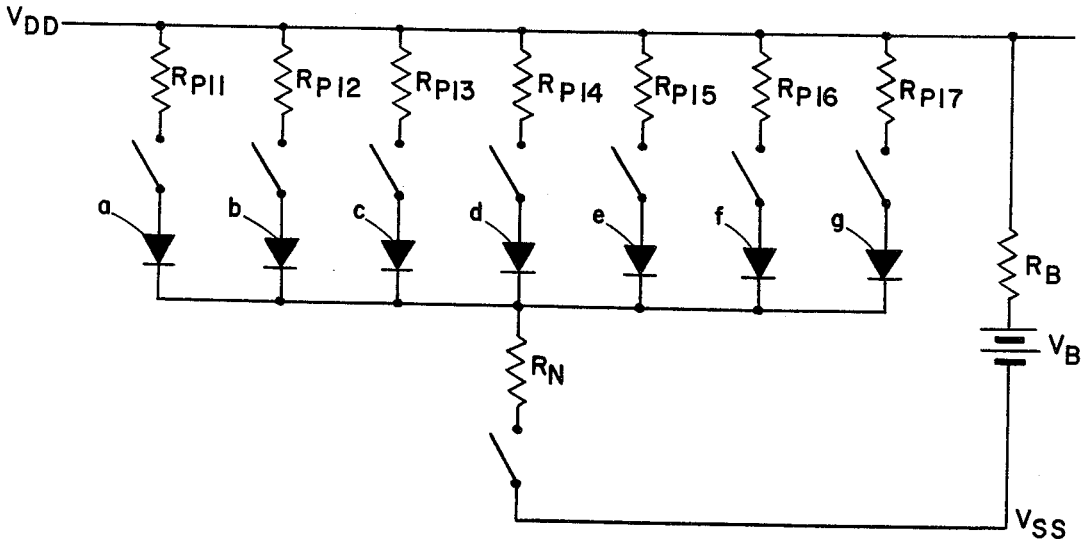
Fig. 3 PRIOR ART
FIG. 3 is an equivalent circuit of the prior art circuit shown in FIG. 2.

In determining the relative internal resistances of the first N-type MOSFET switches 41 through 44 and of the additional N-type MOSFET switches 61 through 69, it is necessary to compensate for both (1) the smaller voltage drop across the equivalent resistances $R_N$ of whichever ones of the MOSFET switches 41 – 44 and 61 – 69 that have been gated closed, and (2) the effect of the battery internal resistance $R_B$ in increasing the equivalent resistances $R_P$ and $R_N$, both resulting from the number of illuminated LED segments being increased. (See FIG. 3.)

The additional switches in a first set 61 through 64 are gated closed when their respective NOR gates 71 through 74 receive a binary zero first input signal on their respective input lines 46 through 49 and also receive a binary zero signal from an inverter 87. The inverter 87 receives the second input signals on lines 56 through 57 through the NAND gate 85 and provides a binary zero output signal to NOR gates 71 through 74 only when either segment "*f*" and/or segment "*g*" is to be illuminated for display.

The additional switches in a second set 65 through 68 are gated closed when their respective NOR gates 75 through 78 receive a binary zero first imput signal on their respective input lines 49 and also receive a binary zero signals from both the inverter 87 and the NOR gate 79. The NOR gate 79 receives second input signals on lines 51, 52, 53, 54, 55, 56, and 59 through NOR gates 80, 81, and 82 and provides a zero output signal to NOR gates 75 through 78 only when the LED segments *a, b, c, d, e, f,* and *i* are to be illuminated for display in accordance with the following logic expression:

$$(a.c.d.e) + (a.b.f) + (d.i).$$

Accordingly, a given additional switch in the first set 61 through 64 is gated closed with the closure of its parallel connected first switch 41 through 44 whenever the second input signals indicate that any of the characters "2", "3", "4", "5", "E", "F", "H", or "U" is selected for display.

Both an additional switch of the first set 61 through 64 and a parallel connected additional switch of the second set 65 through 68 are gated closed with the closure of their parallel connected first switch 41 through 44 whenever the second input signals indicate any of the characters "8", "9", "0", "A", "M", "R", or "W" is selected for display.

Whenever the second input signals indicate that any of the characters "1", "7" or "T" is selected for display none of the additional switches 61 through 68 is gated closed.

Thus, it is seen that whenever the character selected for display has more than three illuminated LED segments, the switches in the first additional set 61 through 64 are enabled for closure so as to reduce the resistance to current flow through the illuminated LED segments, both the switches in the first additional set 61 through 64 and the switches in the second additional set 65 through 69 are enabled for closure so as to still further reduce the resistance to current flow through the illuminated LED segments.

Still another N-type MOSFET switch 69 is connected in parallel with the first switch 44 to one of the digit sections 24. Closure of the switch 69 is enabled when a binary zero first input signal appears on line 49 and when a binary zero signal is received on line 89 and passed through NOR gate 83. A binary zero signal is provided on line 89 when the LED segments for displaying a colon symbol (see FIG. 1) are to be illuminated. Since the colon LED segments have their cathodes connected to the common cathode connection 24*a*, it is necessary that the resistance to current flow through the illuminated LED segments in the digit section 24 be further reduced whenever the colon segments also are illuminated.

Figure 5:
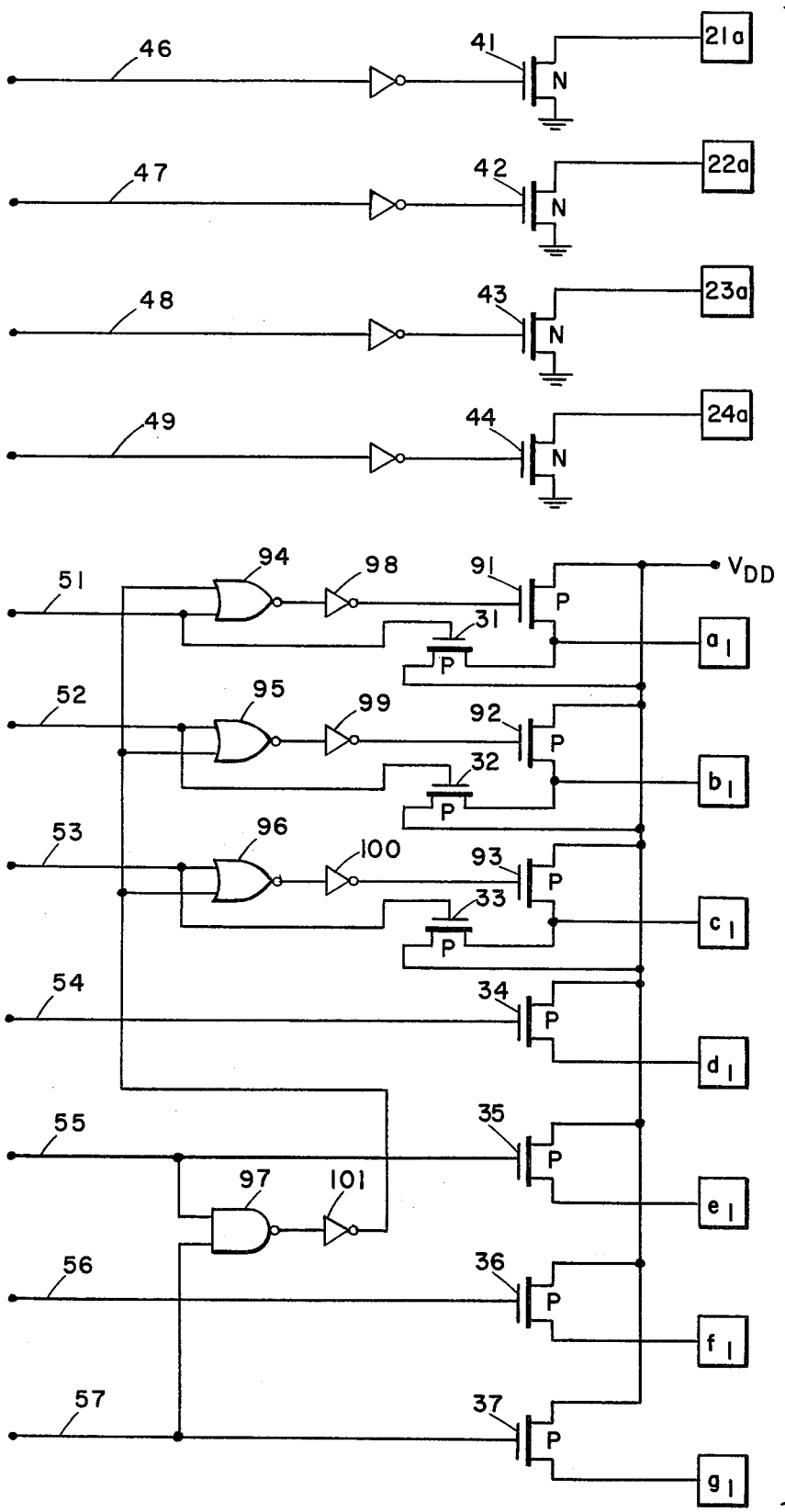
FIG. 5 is a schematic circuit diagram of an alternative preferred embodiment of an LED display device drive circuit according to the present invention.

The embodiment shown in FIG. 5 has a drive circuit for driving digit sections having only seven LED segments. This embodiment includes N-type MOSFET switches 41 through 44 for coupling commonly connected digit section cathodes 21*a* through 24*a* to a source of voltage potential $V_{SS}$ (shown as circuit ground), the same as in the embodiment of FIG. 4; and like reference numerals are used to represent like components in both embodiments. This embodiment also includes a first set of P-type MOSFET switches 31 through 37 for coupling the LED segments anodes $a_1$ through $g_1$ to a source of voltage potential $V_{DD}$, as in the embodiment of FIG. 4.

The control circuit of the embodiment of FIG. 5 includes three additional P-type MOSFET switches 91, 92, and 93 and a logic circuit that includes NOR gates 94, 95, and 96, a NAND gate 97 and inverters 98, 99, 100, and 101.

The three additional P-type MOSFET switches 91, 92, and 93 are each connected in parallel with one of the first mentioned P-type MOSFET switches 31, 32, and 33 that are connected to the LED segment anodes $a_1$, $b_1$, and $c_1$ as shown in FIG. 5.

The first P-type MOSFET switches 34 through 37 that are connected to only those four LED segments "*d*", "*e*", "*f*", and "*g*" that are not illuminated when either a "1" or a "7" is displayed have a first internal resistance. The first P-type MOSFET switches 31 through 33 that are connected to the remaining three LED segments "*a*", "*b*", and "*c*" have a second internal resistance that is higher than the first internal resistance. The additional P-type MOSFET switches 91, 92, and 93 each have an internal resistance that is such that when an additional switch 91, 92, or 93 is gated closed to conduct in parallel with a closed first P-type MOSFET switch 31, 32, or 33 having the second internal resistance, the combined internal resistance of the parallel connected pair of conducted P-type MOSFET switches (31, 32, or 33), and (91, 92, or 93) approximates the first internal resistance.

In determining the relative internal resistances of the first P-type MOSFET switches 31 through 37 and of the additional P-type MOSFET switches 91, 92, and 93, it is necessary to compensate for both (1) the smaller voltage drop across the equivalent resistances $R_p$ of whichever ones of the MOSFET switches 31 – 37 and 91 – 93 that have been gated closed, and (2) the effect of the battery internal resistance $R_B$ in increasing the equivalent resistances $R_P$ and $R_N$, both resulting from the number of illuminated LED segments being increased. (See FIG. 3)

This allows the current flow through the segments of a digit section displaying a character other than an "1" or a "7" to provide the same apparent brightness as a digit section displaying a "1" or a "7".

The additional P-type MOSFET switches 91 through 93 are gated closed by binary signals from the inverters 98 through 100 respectively when the NOR gates 94 through 96 to which these inverters 98 through 100 are connected receive binary zero second input signals on lines 51 through 53 respectively and also a binary zero signal from the inverter 101. The inverter 101 provides a binary zero signal whenever a binary zero signal is provided to either or both inputs of NAND gate 97 thereby indicating that the character selected for display includes either an illuminated "*e*" LED segment and/or an illuminated "*g*" LED segment. Either an "*e*" or "*g*" segment is illuminated in every numeral except "1" or "7".

Thus, it is seen that the logic circuit is responsive to various combinations of second input signals to gate closed an additional P-type MOSFET switch 91, 92, and/or 93 that is connected to an anode $a_1$, $b_1$, $c_1$ of a segment "*a*", "*b*", "*c*" that is illuminated for displaying a "1" or a "7", whenever the second input signals indicate that the particular segment "*a*", "*b*", or "*c*" is to be illuminated for displaying a character other than a "1" or a "7".

Having described my invention, I now claim:

1. An LED display device, comprising;

a plurality of digit sections, each of which includes a plurality of LED segments in an array for providing illuminated displays of selected alphanumeric characters;

first circuit means for separately enabling each of the digit sections for display in response to a different predetermined first input signal; and second circuit means for separately enabling given LED segments in a given digit section simultaneously for displaying a selected character in response to a predetermined combination of second input signals;

whereby the given LED segments in the given digit section are enabled to display the selected character in response to predetermined combinations of first and second input signals;

wherein the improvement comprises;

control means for controlling the amount of energy provided to each given digit section for illumination of the given LED segments in accordance with the selection of the character to be displayed by the given digit section as indicated by the second input signals, to compensate for apparent dimness in digit sections having more segments illuminated than others.

2. An LED display device according to claim 1, wherein the first circuit means comprise a separate first semiconductor switch for each digit section, each first semiconductor switch being gate closed in response to a different predetermined first input signal for coupling common electrodes of all of the LED segments in said digit section to a source of a voltage potential, wherein each first semiconductor switch has an internal resistance which limits the amount of current flow through the LED segments that are enabled; and the control means is characterized by;

additional semiconductor switches connected in parallel with the first semiconductor switches for decreasing said resistance to current flow when said additional semiconductor switches are gated closed; and logic means responsive to different combinations of said second input signals to provide control signals for selectively enabling the closing of certain ones of the additional semiconductor switches in accordance with the particular combinations of LED segments that are enabled for illumination by said second input signals.

3. An LED display device according to claim 2, wherein each digit section includes seven segments for providing illuminated displays of the ten numerals "0" through "9", characterized by;

the additional semiconductor switches comprising a first set of additional semiconductor switches, wherein one of each is connected in parallel with a said first semiconductor switch; and the logic means being responsive to said combination of second input signals for enabling the closing of the additional semiconductor switches in said first set whenever said second input signals indicate that a character having more than three illuminated segments is elected for display.

4. An LED display device according to claim 3, characterized by;

the additional semiconductor switches comprising a second set of additional semiconductor switches, wherein one of each is connected in parallel with a said first semiconductor switch; and the logic means being responsive to said combinations of second input signals for enabling the closing of the additional semiconductor switches in the second set whenever said second input signals indicate that a character having at least six illuminated segments is selected for display.

5. An LED display device according to claim 1, wherein the second circuit means comprise a separate first semiconductor switch for each common LED segment position in the plurality of digit sections, each first semiconductor switch being gated closed in response to a different predetermined second input signal for coupling the electrodes of said commonly positioned LED segments in the plurality of digit sections to a source of voltage potential, wherein each first semiconductor switch has an internal resistance which limits the amount of current flow through the LED segments that are enabled; and the control means is characterized by;

additional semiconductor switches connected in parallel with at least some of the first semiconductor switches for decreasing said resistance to current flow when said additional semiconductor switches are gated closed; and logic means responsive to different combinations of said second input signals for selectively enabling the closing of certain ones of the additional semiconductor switches in accordance with the particular combinations of LED segments that are enabled for illumination by said second input signals.

6. An LED display device according to claim 5, wherein each digit section includes seven segments for providing illuminated displays of the ten numerals "0" through "9", characterized by;

the first semiconductor switches that are for coupling only those four segments that are not illuminated when either a "1" or a "7" is displayed having a first internal resistance;

the first semiconductor switches that are for coupling the remaining three segments having a second internal resistance that is higher than said first internal resistance;

the additional semiconductor switches each being connected in parallel with a first semiconductor switch having said second internal resistance, and having an internal resistance such that when a pair of said parallel connected semiconductor switches is gated closed the combined internal resistance of said parallel connected pair of semiconductor switches approximates said first internal resistance; and the logic means being responsive to said combinations of second input signals to close an additional semiconductor switch connected in parallel with a said first semiconductor switch that is for coupling a said segment that is illuminated for displaying a "1" or a "7", whenever said second input signals indicate that said segment is to be illuminated for displaying a numeral other than a "1" or a "7".

7. An LED display device according to claim 1, wherein the first circuit means comprises a separate first MOSFET switch for each digit section, each first MOSFET switch being gated closed in response to a different predetermined first input signal for coupling common electrodes of all of the segments in said digit section to a source of a voltage potential, wherein each first MOSFET switch has an internal resistance which limits the amount of current flow through the segments that are enabled; and the control means is characterized by;

additional MOSFET switches connected in parallel with the first MOSFET switches for decreasing said resistance to current flow when said additional MOSFET switches are gated closed; and logic means responsive to different combinations of said second input signals to provide control signals for selectively enabling the closing of certain ones of the additional MOSFET switches in accordance with the particular combinations of segments that are enabled for illumination by said second input signals.

8. An LED display device according to claim 7, wherein each digit section includes seven segments for providing illuminated displays of the ten numerals "0" through "9", characterized by;

the additional MOSFET switches comprising a first set of additional MOSFET switches, wherein one of each is connected in parallel with said first MOSFET switch; and the logic means being responsive to said combination of second input signals for enabling the closing of the additional MOSFET switches in said first set whenever said second input signals indicate that a character having more than three illuminated segments is elected for display.

9. An LED display device according to claim 8, characterized by;

the additional MOSFET switches comprising a second set of additional MOSFET switches, wherein one of each is connected in parallel with a said first MOSFET switch; and the logic means being responsive to said combinations of second input signals for enabling the closing of the additional MOSFET switches in the second set whenever said second input signals indicate that a character having at least six illuminated segments is selected for display.

10. An LED display device according to claim 1, wherein the second circuit means comprises a separate first MOSFET switch for each common segment position in the plurality of digit sections, each first MOSFET switch being gated closed in response to a different predetermined second input signal for coupling the electrodes of said commonly positioned segments in the plurality of digit sections to a source of voltage potential, wherein each first MOSFET switch has an internal resistance which limits the amount of current flow through the segments that are enabled; and the control means is characterized by;

additional MOSFET switches connected in parallel with at least some of the first MOSFET switches for decreasing said resistance to current flow when said additional MOSFET switches are gated closed; and logic means responsive to different combinations of said second input signals for selectively enabling the closing of certain ones of the additional MOSFET switches in accordance with the particular combinations of segments that are enabled for illumination by said second input signals.

11. An LED display device according to claim 10, wherein each digit section includes seven segments for providing illuminated displays of the ten numerals "0" through "9", characterized by;

the first MOSFET switches that are for coupling only those four segments that are not illuminated when either a "1" or a "7" is displayed having a first internal resistance;

the first MOSFET switches that are for coupling the remaining three segments having a second internal resistance that is higher than said first internal resistance;

the additional MOSFET switches each being connected in parallel with a first MOSFET switch having said second internal resistance, and having an internal resistance such that when a pair of said parallel connected MOSFET switches is gated closed the combined internal resistance of said parallel connected pair of MOSFET switches approximates said first internal resistance; and the logic means being responsive to said combinations of second input signals to close an additional MOSFET switch connected in parallel with a said first MOSFET switch that is for coupling a said segment that is illuminated for displaying a "1" or a "7", whenever said second input signals indicate that said segment is to be illuminated for displaying a numeral other than a "1" or a "7".

12. An electroluminescent display device, comprising;

a plurality of digit sections, each of which includes a plurality of electroluminescent segments in an array for providing illuminated displays of selected alphanumeric characters;

first circuit means for separately enabling each of the digit sections for display in response to a different predetermined first input signal; and second circuit means for separately enabling given segments in a given digit section simultaneously for displaying a selected character in response to a predetermined combination of second input signals;

whereby the given segments in the given digit section are enabled to display the selected character in response to predetermined combinations of first and second input signals;

wherein the improvement comprises;

control means for controlling the amount of energy provided to each given digit section for illumination of the given segments in accordance with the selection of the character to be displayed by the given digit section as indicated by the second input signals, to compensate for apparent dimness in digit sections having more segments illuminated than others.

13. An electroluminescent display device according to claim 12, wherein the first circuit means comprise a separate first semiconductor switch for each digit section, each first semiconductor switch being gated closed in response to a different predetermined first input signal for coupling common electrodes of all of the segments in said digit section to a source of a voltage potential, wherein each first semiconductor switch has an internal resistance which limits the amount of current flow through the segments that are enabled; and the control means is characterized by;

additional semiconductor switches connected in parallel with the first semiconductor switches for decreasing said resistance to current flow when said additional semiconductor switches are gated closed; and logic means responsive to different combinations of said second input signals to provide control signals for selectively enabling the closing of certain ones of the additional semiconductor switches in accordance with the particular combinations of segments that are enabled for illumination by said second input signals.

14. An electroluminescent display device according to claim 12, wherein the second circuit means comprise a separate first semiconductor switch for each common segment position in the plurality of digit sections, each first semiconductor switch being gated closed in response to a different predetermined second input signal for coupling the electrodes of said commonly positioned segments in the plurality of digit sections to a source of voltage potential, wherein each first semiconductor switch has an internal resistance which limits the amount of current flow through the segments that are enabled; and the control means is characterized by;

additional semiconductor switches connected in parallel with at least some of the first semiconductor switches for decreasing said resistance to current flow when said additional semiconductor switches are gated closed; and logic means responsive to different combinations of said second input signals for selectively enabling the closing of certain ones of the additional semiconductor switches in accordance with the particular combinations of segments that are enabled for illumination by said second input signals.

15. A drive circuit for an LED display device that includes a plurality of digit sections, each of which includes a plurality of LED segments in an array for providing illuminated displays of selected alphanumeric characters, the drive circuit comprising;

first circuit means for separately enabling each of the digit sections for display in response to a different predetermined first input signal; and second circuit means for separately enabling given LED segments in a given digit section simultaneously for displaying a selected character in response to a predetermined combination of second input signals;

whereby the given LED segments in the given digit section are enabled to display the selected character in response to predetermined combinations of first and second input signals;

wherein the improvement comprises;

control means for controlling the amount of energy provided to each given digit section for illumination of the given LED segments in accordance with the selection of the character to be displayed by the given digit section as indicated by the second input signals, to compensate for apparent dimness in digit sections having more segments illuminated than others.

16. A drive circuit according to claim 15, wherein the first circuit means comprise a separate first semiconductor switch for each digit section, each first semiconductor switch being gated closed in response to a different predetermined first input signal for coupling common electrodes of all of the LED segments in said digit section to a source of a voltage potential, wherein each first semiconductor switch has an internal resistance which limits the amount of current flow through the LED segments that are enabled; and the control means is characterized by;

additional semiconductor switches connected in parallel with the first semiconductor switches for decreasing said resistance to current flow when said additional semiconductor switches are gated closed; and logic means responsive to different combinations of said second input signals to provide control signals for selectively enabling the closing of certain ones of the additional semiconductor switches in accordance with the particular combinations of LED segments that are enabled for illumination by said second input signals.

17. A drive circuit according to claim 15, wherein the second circuit means comprise a separate first semiconductor switch for each common LED segment position in the plurality of digit sections, each first semiconductor switch being gated closed in response to a different predetermined second input signal for coupling the electrodes of said commonly positioned LED segments in the plurality of digit sections to a source of voltage potential, wherein each first semiconductor switch has an internal resistance which limits the amount of current flow through the LED segments that are enabled; and the control means is characterized by;

additional semiconductor switches connected in parallel with at least some of the first semiconductor switches for decreasing said resistance to current flow when said additional semiconductor switches are gated closed; and logic means responsive to different combinations of said second input signals for selectively enabling the closing of certain ones of the additional semiconductor switches in accordance with the particular combinations of LED segments that are enabled for illumination by said second input signals.

18. A drive circuit for an electroluminescent display device that includes a plurality of digit sections, each of which includes a plurality of electroluminescent segments in an array for providing illuminated displays of selected alphanumeric characters, the drive circuit comprising;

first circuit means for separately enabling each of the digit sections for display in response to a different predetermined first input signal; and second circuit means for separately enabling given segments in a given digit section simultaneously for displaying a selected character in response to a predetermined combination of second input signals;

whereby the given segments in the given digit section are enabled to display the selected character in response to predetermined combinations of first and second input signals;

wherein the improvement comprises;

control means for controlling the amount of energy provided to each given digit section for illumination of the given segments in accordance with the selection of the character to be displayed by the given digit section as indicated by the second input signals, to compensate for apparent dimness in digit sections having more segments illuminated than others.

19. A drive circuit according to claim 18, wherein the first circuit means comprise a separate first semiconductor switch for each digit section, each first semiconductor switch being gated closed in response to a different predetermined first input signal for coupling common electrodes of all of the segments in said digit section to a source of a voltage potential, wherein each first semiconductor switch has an internal resistance which limits the amount of current flow through the segments that are enabled; and the control means is characterized by;

additional semiconductor switches connected in parallel with the first semiconductor switches for decreasing said resistance to current flow when said additional semiconductor switches are gated closed; and logic means responsive to different combinations of said second input signals to provide control signals for selectively enabling the closing of certain ones of the additional semiconductor switches in accordance with the particular combinations of segments that are enabled for illumination by said second input signals.

20. A drive circuit according to claim 19, for a display wherein each digit section includes seven segments for providing illuminated displays of the ten numerals "0" through "9", characterized by;

the additional semiconductor switches comprising a first set of additional semiconductor switches, wherein one of each is connected in parallel with a said first semiconductor switch; and the logic means being responsive to said combination of second input signals for enabling the closing of the additional semiconductor switches in said first set whenever said second input signals indicate that a character having more than three illuminated segments is elected for display.

21. A drive circuit according to claim 20, characterized by;

the additional semiconductor switches comprising a second set of additional semiconductor switches, wherein one of each is connected in parallel with a said first semiconductor switch; and the logic means being responsive to said combinations of second input signals for enabling the closing of the additional semiconductor switches in the second set whenever said second input signals indicate that a character having at least six illuminated segments is selected for display.

22. A drive circuit according to claim 18, wherein the second circuit means comprise a separate first semiconductor switch for each common segment position in the plurality of digit sections, each first semiconductor switch being gated closed in response to a different predetermined second input signal for coupling the electrodes of said commonly positioned segments in the plurality of digit sections to a source of voltage potential, wherein each first semiconductor switch has an internal resistance which limits the amount of current flow through the segments that are enabled; and the control means is characterized by;

additional semiconductor switches connected in parallel with at least some of the first semiconductor switches for decreasing said resistance to current flow when said additional semiconductor switches are gated closed; and logic means responsive to different combinations of said second input signals for selectively enabling the closing of certain ones of the additional semiconductor switches in accordance with the particular combinations of segments that are enabled for illumination by said second input signals.

23. A drive circuit according to claim 22, for a display wherein each digit section includes seven segments for providing illuminated displays of the ten numerals "0" through "9", characterized by;

the first semiconductor switches that are for coupling only those four segments that are not illuminated when either a "1" or a "7" is displayed having a first internal resistance;

the first semiconductor switches that are for coupling the remaining three segments having a second internal resistance that is higher than said first internal resistance;

the additional semiconductor switches each being connected in parallel with a first semiconductor switch having said second internal resistance, and having an internal resistance such that when a pair of said parallel connected semiconductor switches is gated closed the combined internal resistance of said parallel connected pair of semiconductor switches approximates said first internal resistance; and the logic means being responsive to said combinations of second input signals to close an additional semiconductor switch connected in parallel with a said first semiconductor switch that if for coupling a said segment that is illuminated for displaying a "1" or a "7", whenever said second input signals indicate that said segment is to be illuminated for displaying a numeral other than a "1" or a "7".

24. A drive circuit according to claim 18, wherein the first circuit means comprise a separate first MOSFET switch for each digit section, each first MOSFET switch being gated closed in response to a different predetermined first input signal for coupling common electrodes of all of the segments in said digit section to a source of a voltage potential, wherein each first MOSFET switch has an internal resistance which limits the amount of current flow through the segments that are enabled; and the control means is characterized by;

additional MOSFET switches connected in parallel with the first MOSFET switches for decreasing said resistance to current flow when said additional MOSFET switches are gated closed; and logic means responsive to different combinations of said second input signals to provide control signals for selectively enabling the closing of certain ones of the additional MOSFET switches in accordance with the particular combinations of segments that are enabled for illumination by said second input signals.

25. A drive circuit according to claim 24, for a display wherein each digit section includes seven segments for providing illuminated displays of the ten numerals "0" through "9", characterized by;

the additional MOSFET switches comprising a first set of additional MOSFET switches, wherein one of each is connected in parallel with a said first MOSFET switch; and the logic means being responsive to said combination of second input signals for enabling the closing of the additional MOSFET switches in said first set whenever said second input signals indicate that a character having more than three illuminated segments is elected for display.

26. A drive circuit according to claim 25, characterized by;

the additional MOSFET switches comprising a second set of additional MOSFET switches, wherein one of each is connected in parallel with a said first MOSFET switch; and the logic means being responsive to said combinations of second input signals for enabling the closing of the additional MOSFET switches in the second set whenever said second input signals indicate that a character having at least six illuminated segments is selected for display.

27. A drive circuit according to claim 18, wherein the second circuit means comprise a separate first MOSFET switch for each common segment position in the plurality of digit sections, each first MOSFET switch being gated closed in response to a different predetermined second input signal for coupling the electrodes of said commonly positioned segments in the plurality of digit sections to a source of voltage potential, wherein each first MOSFET switch has an internal resistance which limits the amount of current flow through the segments that are enabled; and the control means is characterized by;

additional MOSFET switches connected in parallel with at least some of the first MOSFET switches for decreasing said resistance to current flow when said additional MOSFET switches are gated closed; and logic means responsive to different combinations of said second input signals for selectively enabling the closing of certain ones of the additional MOSFET switches in accordance with the particular combinations of segments that are enabled for illumination by said second input signals.

28. A drive circuit according to claim 27, for a display wherein each digit section includes seven segments for providing illuminated displays of the ten numerals "0" through "9", characterized by;

the first MOSFET switches that are for coupling only those four segments that are not illuminated when either a "1" or a "7" is displayed having a first internal resistance;

the first MOSFET switches that are for coupling the remaining three segments having a second internal resistance that is higher than said first internal resistance;

the additional MOSFET switches each being connected in parallel with a first MOSFET switch having said second internal resistance, and having an internal resistance such that when a pair of said parallel connected MOSFET switches is gated closed the combined internal resistance of said parallel connected pair of MOSFET switches approximates said first internal resistance; and the logic means being responsive to said combinations of second input signals to close an additional MOSFET switch connected in parallel with a said first MOSFET switch that is for coupling a said segment that is illuminated for displaying a "1" or a "7", whenever said second input signals indicate that said segment is to be illuminated for displaying a numeral other than a "1" or a "7".

* * * * *